United States Patent [19]

Frehser et al.

[11] 3,930,531

[45] Jan. 6, 1976

[54] METHOD FOR MANUFACTURING INGOTS OF HIGH-MELTING FERROALLOYS AND METAL ALLOYS WITH GOOD FORMING PROPERTIES

[75] Inventors: Josef Frehser; Christian Kubisch, both of Kapfenberg; Karl Swoboda, Vienna, all of Austria

[73] Assignee: Vereinigte Edelstahlwerke Aktiengesellschaft, Vienna, Austria

[22] Filed: May 28, 1974

[21] Appl. No.: 474,101

[30] Foreign Application Priority Data

May 30, 1973 Austria ..... 4740/73

[52] U.S. Cl. ..... 164/52; 164/57; 164/68

[51] Int. Cl.[2] ..... B22D 27/02

[58] Field of Search ..... 164/52, 57, 68, 252, 259

[56] References Cited

UNITED STATES PATENTS 3,067,473 12/1962 Hopkins ..... 164/52

3,669,178 6/1972 Theisen ..... 164/50

3,768,543 10/1973 Kolisnyk ..... 164/252

*Primary Examiner*—R. J. Shore

*Assistant Examiner*—John E. Roethel

*Attorney, Agent, or Firm*—Holman & Stern

[57] ABSTRACT

Ingots of high-melting ferroalloys and metal alloys with good forming properties are obtained by melting a consumable electrode in a slag bath in an ingot mold while cooling the ingot mold and providing a high pressure gas inert to the slag above the slag bath. The apparatus is a trisectional pressure chamber including an ingot mold which may be surrounded by a pressure container, a bell-type distributing device surrounding and extending above the mold, a cap for the distributing device through which a guide rod for a consumable electrode is introduced into the mold and a gland mounted in the cap for sealing the pressure chamber.

11 Claims, 2 Drawing Figures

Fig.1

METHOD FOR MANUFACTURING INGOTS OF HIGH-MELTING FERROALLOYS AND METAL ALLOYS WITH GOOD FORMING PROPERTIES

BACKGROUND OF THE INVENTION

The instant invention concerns a method for manufacturing ingots with good forming properties comprising high-melting ferroalloys and metal alloys, especially high-alloyed steels such as austenitic chromium-nickel-steels or nickel-cobalt-base alloys. These alloys produced by conventional processes are very difficult to form due to their very coarse solidification texture and due to unavoidable segregations in their ingots. The forming difficulties make it necessary to first form the ingots by means of extrusion namely, by means of a pure compression strain.

In order to prevent a coarse solidification texture, it is desirable that the respective solidified area of the ingot be maintained as small as possible and kept under high pressure during the solidification phase. Segregations in the ingot may also be extensively excluded by utilizing the electroslag remelting method.

SUMMARY OF THE INVENTION

Extensive tests have proven that a combination of the electroslag remelting method and the melting under high pressure, which is suitably bulit up over a slag layer with the help of a gas, requires the utilization of a slag which does not react with the gas. In the presence of nitrogen the slag should have no or only very little nitrogen solubility in order to prevent unavoidable nitrogen transitions from the slag into the steel bath, since such nitrogen transitions could lead to local defects. It is furthermore necessary that intensive cooling of the ingot mold be provided, since it is desired that the purest possible grains be obtained in the area of the external zone (case) which is extremely important for the initial forming phases. To increase the cooling, a water coolant may be replaced with a liquid metal such as liquid sodium, the temperature of which may be between 350° and 650°C. This type of cooling is recommended especially for an ingot mold with a large diameter in order to avoid excessively large cooling spaces in the ingot mold, namely, spaces for receiving the quantitative flow of the coolant. The degree of cooling should be measured so that the slag in the area of the immersed electrode is liquid and in the area of the ingot wall in contrast thereto is in solid form. This solid slag area should measure not more than 1/10 of the diameter of the ingot mold, or should be of a comparable measurement of the ingot. In general, however, 1/100 of the diameter of the ingot mold is sufficient for this slag area.

It is the object of the instant invention to provide a method of manufacturing ingots of high-melting ferroalloys and metal alloys which have good forming properties and a fine-grained solidification texture by melting at least one consumable electrode according to the principle of the growing block in a liquid-cooled ingot. The instant invention comprises melting the electrode in a slag layer, above which is located a gas under high pressure, which gas does not react with the slag. By controlling the cooling of the ingot in the area of the immersed electrode, the liquid condition of the slag is retained, and in the area of the ingot wall the solidified condition of the slag is retained, both conditions being retained during the entire melting process.

BRIEF DESCRIPTION OF THE DRAWINGS

The present invention will be better understood by referring to the drawings in which.

DETAILED DESCRIPTION OF THE PREFERRED EMBODIMENTS

Figure 1:
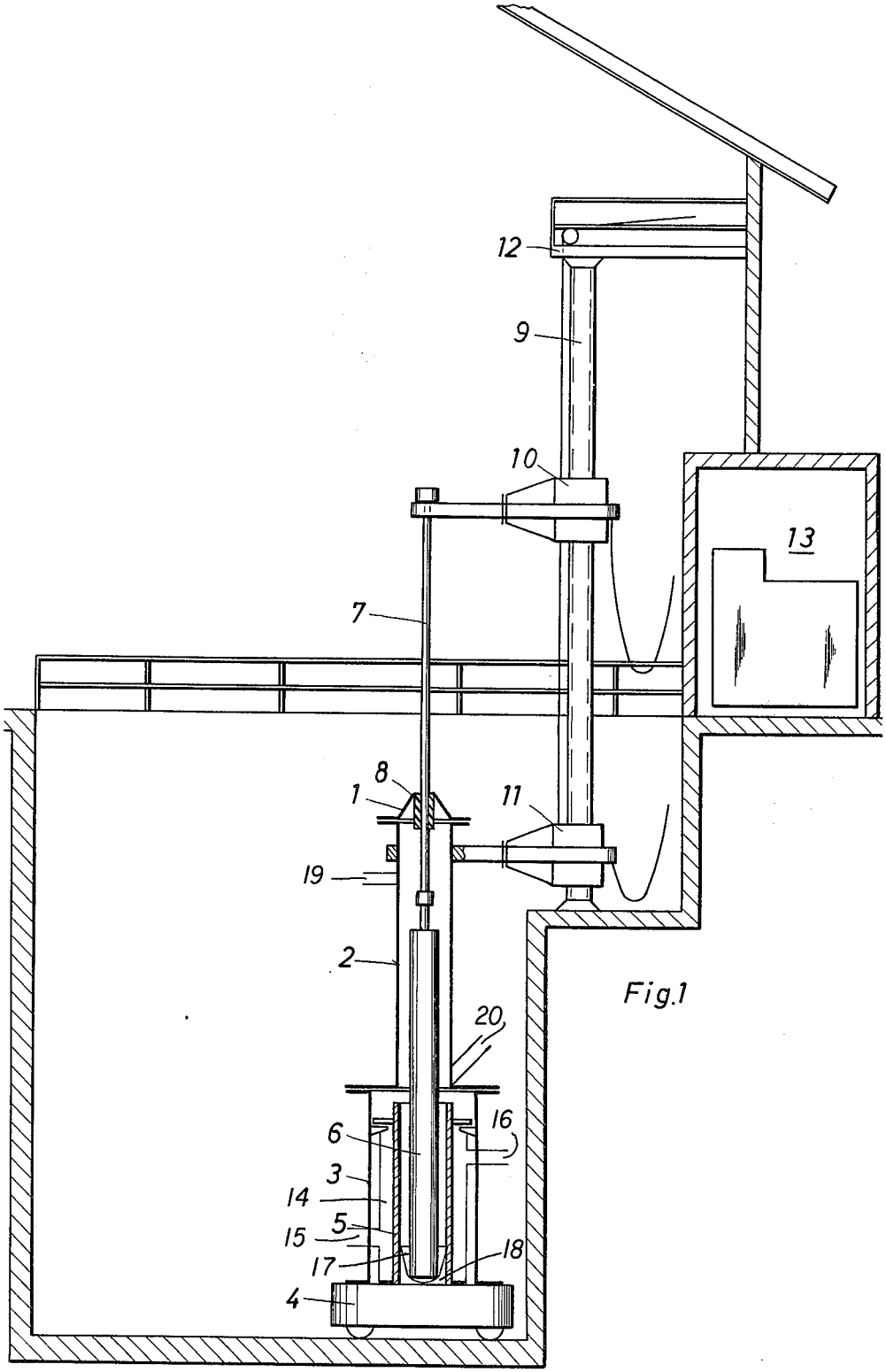
FIG. 1 is a schematic illustration of an apparatus for performing the method of the invention and FIG. 2 is a schematic illustration of an apparatus similar to the apparatus of FIG. 1 for producing small ingots.

The method of the instant invention may be performed in an apparatus such as that which is schematically illustrated in FIG. 1. The apparatus comprises essentially a trisectional pressure chamber, whereby the three sections are a pressure-container 3, a bell-type distributing device 2, and a cap (or roof) 1. Through the cap a guide rod 7 for a consumable electrode 6 is guided, which extends into an ingot mold 5. The mold 5 is surrounded by a jacket 14 with an inlet 15 and an outlet 16 through which a liquid coolant can travel. The sealing between the guide rod 7 and the pressure chamber is made by means of a gland 8 which is mounted in the cap (or roof) 1. After the melting of electrode 6 and the complete solidification of the block built up in the ingot mold, this block can then be removed from the apparatus with the aid of an ingot-conveying device 4. The guiding of the consumable electrode, namely, the respective adjustment of its elevation, is made by means of an electrode buggie 10 (or carrier) which moves up and down along a column sleeve 9. The cloumn sleeve 9 is also utilized for a lift device 11 of the bell-type distributing device 2. Electrical devices are operated from area 13; at 12 is indicated a gearing platform which enables the movement of the electrode buggie 10 and the lift device 11. A liquid slag area 17 and a solid slag area 18 are both present in the mold 5 during the melting phase.

Figure 2:
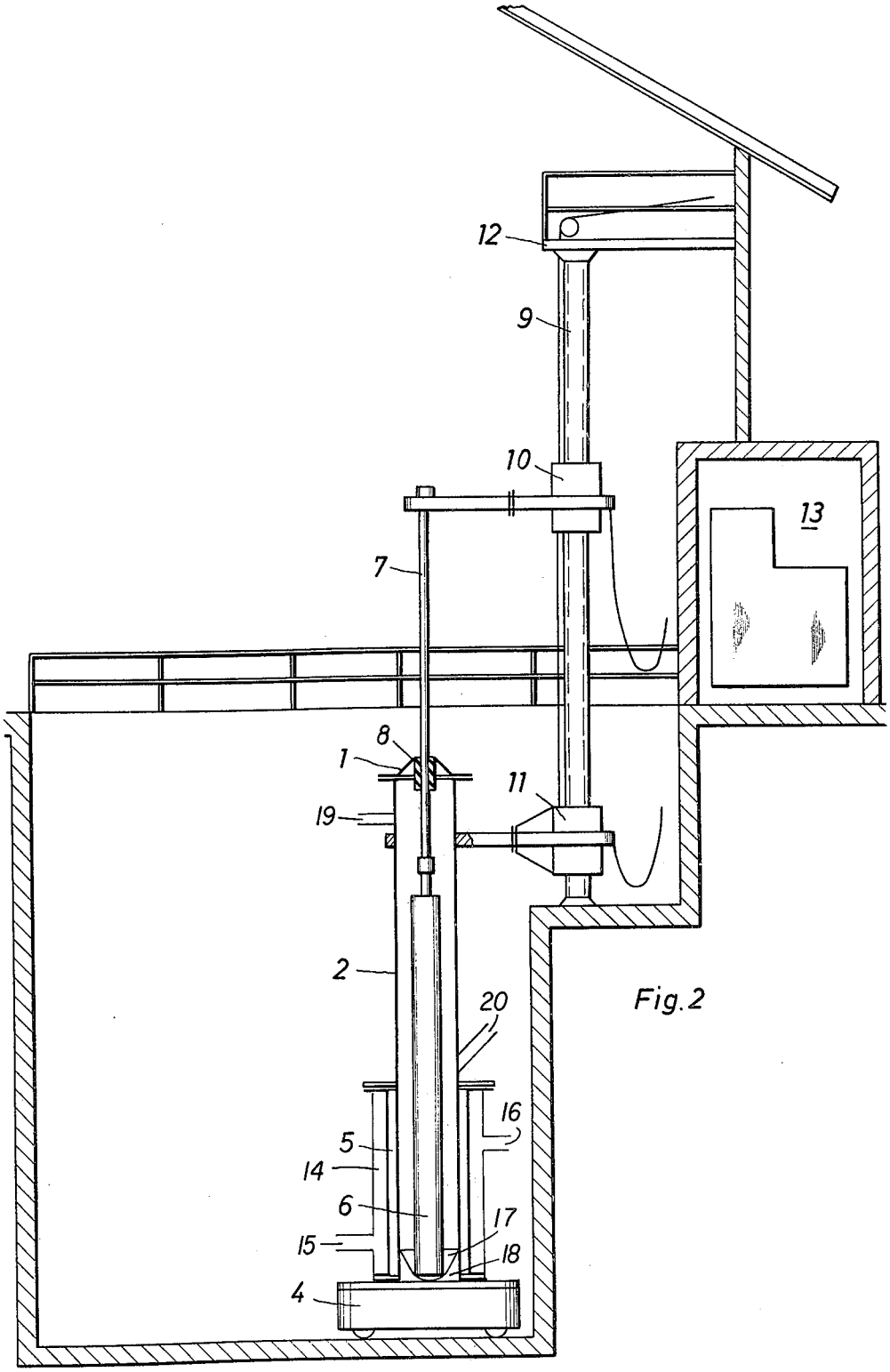

For manufacturing small ingots such as round blocks with up to 500 mm diameter, a simply constructed apparatus such as illustrated in FIG. 2 can be utilized. The essential difference in this apparatus in comparison with the installation shown in FIG. 1 is that the ingot mold 5 is itself a part of the trisectional pressure chamber. This pressure chamber comprises, in addition to the ingot mold 5, the bell-type distribution device 2 and the cap (or roof) 1.

The necessary gas pressure above the slag layer, which, for example, may be produced by means of argon, in austenitic chromium-nickel-steels or in nickel-base alloys should not be below 20 atmospheres in order to obtain essential and intensive effects on the solidification texture. The inert gas is supplied through means 19 in the bell-type distribution device 2.

EXAMPLE OF OPERATION

For manufacturing an ingot weighing 500 kg and comprising a practically non-deformable cobalt-base alloy of 1.2% C, 1.0% Si, 0.15% Mn, 25.0% Cr, 4.5% W, the remainder being cobalt, a consumable electrode having a diameter of 110 mm, was melted in a slag comprising 50% $CaF_2$, 20% $SiO_2$, 15% CaO and 15% MgO in an apparatus according to FIG. 2. A pressure of 35 atmospheres was maintained over the slag with argon during the melting phase up to the solidification of the ingot in a water-cooled copper-ingot mold.

The final analysis of the ingot produced was 1.19% C, 0.84% Si, 0.19% Mn, 25.74% Cr, 4.37% W, 3.33% Fe and 63.28% Co. This ingot, having a diameter of 200 mm, was first forged to 90 mm and thereafter rolled to 8 mm.

The formability of this barely formable alloy could thus be improved in a decisive manner by utilizing the inventive melting under pressure.

The method according to the instant invention may also be utilized in a manner whereby simultaneously with the continuous melting of at least one electrode rod or band-electrode in the slag bath, a material compound is added thereto in powder-, granulate- or particle-form, which can serve various purposes. The insertion of such admixtures can be made continuously with the aid of a base gas which is preferably the same gas which produces the necessary gas pressure above the slag. The additives, however, may also be inserted in partial quantities during the melting process with the aid of apportioning devices. For adding material to the apparatus, there may be provided lead-ins in the cap (or roof) 1 of the trisectional pressure chamber. It is however also possible to arrange suitable lead-ins at other points of the pressure chamber, for example a line-in 20 in the area of the bell-type distributing device 2.

The inventive method may also be utilized for manufacturing steels and alloys with high nitrogen contents, whereby the required gas pressure can be produced with an inert gas such as argon, or when utilizing a slag which is practically free of carbon without interferring nitrogen solubility such as a slag with 35% $CaF_2$, 35% CaO, 30% $Al_2O_3$, and also with nitrogen. The nitrogen solubility of the slag can be further reduced by means of adding $SiO_2$.

Increasing nitrogen contents, because of the increase of the solidity of the steels, have increased forming difficulties. However, these forming difficulties can be advantageously met with the method of the instant invention.

The utilization of the method for manufacturing steels with high nitrogen contents has already been proposed. In this prior art method, one works with high nitrogen pressures over the slag bath, which, however, must possess a high solubility for nitrogen in order to enable the nitrogenization of the steel ingot. The main difficulty in tis method is that unexpectantly only relatively small amounts of nitrogen are accepted by the steel bath, and that additionally the distribution of the same over the ingot crosscut as well as over the ingot length can be very uneven. This will result not only in additional forming difficulties but also in very uneven mechanical characteristics in dependency of the respective local nitrogen content.

The adding of nitrogen to the steel ingot is inventively made during the melting phase, exclusively by adding nitrogen-containing substances to the slag. Metal nitrides and mixtures of the same are utilized as the nitrogen-containing substances. The addition of these substances may be made in a continuous manner or in several steps. The additions must however be in such dosages so that a homogeneous block builds up during the melting phase.

EXAMPLE OF OPERATION

For manufacturing a round ingot weighing 1420 kg and having a diameter of 400 mm comprising a steel alloy with a high nitrogen content and with approximately 18% Mn, 12% Cr, 2% Ni, and 0.5% Mo, a consumable electrode having a composition of 0.029% C, 0.44% Si, 18.66% Mn, 5.98% Cr, 2.03% Ni, 0.5% Mo, 0.19% N, the remainder being iron and unavoidable steel impurities, with a 260 mm diameter, was melted in a slag comprising 29.1% CaO, 30.8% $Al_2O_3$, 31.5% $CaF_2$ and 5.9% $SiO_2$ in an apparatus as seen in FIG. 1. A pressure of 21 atmospheres was maintained over the slag with nitrogen during the melting phase up to the solidification of the ingot.

To add nitrogen to the steel ingot, 140 kg nitride ferrochromium with a grain size of about 3 mm in equal proportions were added. The additions were made at intervals of 20 seconds. The total melting time inclusive of the top heating amounted to 284 minutes.

The final analysis of the ingot produced was 0.034% C, 0.37% Si, 16.70% Mn, 11.76% Cr, 1.97% Ni, 0.44% Mo and 0.8% N.

The ingot was forged into a capping ring and in spite of the high nitrogen content of 0.8% was satisfactorily formed.

The nitrogen may, however, be added to the slag during the melting phase, and may be of other nitrogen-containing substances or mixtures of the same. Preferably, these will however always be nitrides, especially Cr— or Mn-nitrides. In steels which contain chromium and manganese there may be utilized a mixture of Cr— and Mn-nitride in which are present chromium and manganese in the same ratio as in the consumable electrode. In place of the additives for the alloying with nitrogen, there may also be added other substances for other reasons during the melting phase in powder-, granulate- or particle-form. For example, material comprising the same composition as the consumable electrode, or a mixture which in the molten condition produces the composition of the block may be added. Also, additions for alloying the ingot with chromium, nickel, molybdenum, tungsten, vanadium, etc. are possible by utilizing the respective ferro-alloys.

Deoxidation processes may also be performed by means of additives during the melting phase, especially an additional deoxidation for influencing the composition of the deoxidation products remaining in the ingot. For example, by utilizing alkaline earth metals in the form of deoxidation alloys, deoxidation can also be performed in order to influence in this manner certain material characteristics such as the amendability of the ingot to receive polish or to be machined.

In performing such measures, it is however to be considered that the admixtures have a grain size of not more than 6 mm, preferably not more than 3 mm, in order to be able to melt in the slag layer. For this reason, there should only be utlizied additions which have a melting point of at least 50°C below the temperature of the slag bath. When larger quantities of additions are used, it will then be suitable to add admixtures (alloys) to the apparatus in the above-described condition.

We claim:

1. A method of manufacturing ingots of high-melting ferroalloys and metal alloys having favorable formability and a fine grain solidification texture comprising: melting at least one consumable electrode in a slag bath in an ingot mold; cooling the ingot mold wall with a liquid metal; providing a gas inert to the slag under a pressure of at least 20 atmospheres above the slag; and adjusting the cooling of the ingot mold in the area of the immersed electrode to retain the liquid condition of the slag, and in the area of the ingot mold wall to retain the solid condition of the slag, both conditions being retained during the melting phase to obtain an area of solid slag between the ingot mold wall and liquid slag area of a dimension of between 1/100 and 1/10 of the ingot mold diameter.

2. The method according to claim 1, wherein the liquid metal used to cool the ingot mold is sodium having a temperature of between 350°C and 650°C.

3. The method according to claim 1, wherein the electrode is continuously melted in the slag bath.

4. The method according to claim 1, further comprising adding a nitrogen-containing substance in finely divided form with a maximum grain size of 6 mm to the slag bath during the melting phase.

5. The method according to claim 4, wherein the nitrogen-containing substance is added in a pre-heated condition.

6. The method according to claim 4, wherein the nitrogen-containing substance has a melting point at least 50°C lower than the temperature of the slag bath.

7. The method according to claim 4, wherein the nitrogen-containing substance is a mixture of chromium nitride and manganese nitride and wherein chromium and manganese are present in the same ratio as in the consumable electrode.

8. The method according to claim 1, further comprising adding a ferroalloy in a finely divided form with a maximum grain size of 6 mm to the slag bath during the melting phase.

9. The method according to claim 1, further comprising adding a substance which when melted produces the ingot composition in a finely divided form with a maximum grain size of 6 mm to the slag bath during the melting phase.

10. The method according to claim 1, further comprising adding an alkaline earth metal in a finely divided form with a maximum grain size of 6 mm to the slag bath during the melting phase.

11. The method according to claim 1, further comprising adding a material having the same composition as the consumable electrode in a finely divided form with a maximum grain size of 6 mm to the slag bath during the melting phase.

* * * * *